United States Patent [19]

Bekius

[11] Patent Number: 5,060,869

[45] Date of Patent: Oct. 29, 1991

[54] CERAMIC FLAT SPRAY TIP

[75] Inventor: Wayne Bekius, Milaca, Minn.

[73] Assignee: Wagner Spray Tech Corporation, Minneapolis, Minn.

[21] Appl. No.: 587,541

[22] Filed: Sep. 24, 1990

Related U.S. Application Data

[63] Continuation-in-part of Ser. No. 418,588, Oct. 10, 1989, abandoned.

[51] Int. Cl.[5] ..... B05B 15/06

[52] U.S. Cl. ..... 239/599; 239/600

[58] Field of Search ..... 239/568, 550, 597–599, 239/600, DIG. 22, 526, 591, 596, DIG. 14

[56] References Cited

U.S. PATENT DOCUMENTS

| | | | |
|---|---|---|---|
| 1,151,258 | 2/1915 | Fischer | 239/590 |
| 2,125,445 | 8/1938 | Holveck . | |
| 2,721,764 | 10/1955 | Wilson | 239/547 X |
| 2,985,386 | 5/1961 | Steinen . | |
| 3,045,932 | 7/1962 | Steinen . | |
| 3,101,906 | 8/1963 | Webber . | |
| 3,132,809 | 5/1967 | Cartwright | 239/600 X |
| 3,273,805 | 9/1966 | Hall | 239/600 X |
| 3,398,899 | 8/1968 | Fry . | |
| 3,416,736 | 12/1968 | Marik . | |
| 3,488,006 | 1/1970 | Gigantino . | |
| 3,705,693 | 12/1972 | Franz | 239/600 |
| 3,713,591 | 1/1973 | Watkins | 239/590.3 |
| 3,823,408 | 7/1974 | Gordon, III | 346/140 |
| 3,865,314 | 2/1975 | Levey et al. | 239/590.3 |
| 3,930,619 | 1/1976 | Levey et al. | 239/520 |
| 3,952,955 | 4/1976 | Clements | 239/288.5 |
| 3,963,180 | 6/1976 | Wagner . | |
| 4,025,045 | 5/1977 | Kubiak | 239/600 X |
| 4,103,830 | 8/1978 | Roth | 239/587 |
| 4,141,503 | 2/1979 | Beck . | |
| 4,157,163 | 6/1979 | Pinto et al. | 239/600 X |
| 4,181,261 | 1/1980 | Crum . | |
| 4,239,157 | 12/1980 | Fasth | 239/288.5 |
| 4,258,885 | 3/1981 | Legeza | 239/707 |
| 4,349,947 | 9/1982 | Rood | 29/157 |
| 4,365,758 | 12/1982 | Shaning | 239/600 X |
| 4,527,507 | 7/1985 | Sawai et al. | 118/314 |
| 4,645,127 | 2/1987 | Emery et al. | 239/599 X |
| 4,776,412 | 10/1988 | Thompson | 239/600 X |
| 4,884,742 | 12/1989 | Bekins et al. | 239/600 X |
| 4,899,937 | 2/1990 | Haruch | 239/600 X |

FOREIGN PATENT DOCUMENTS

| | | | |
|---|---|---|---|
| 3438317 | 6/1986 | Fed. Rep. of Germany | 239/600 |
| 3602941 | 4/1987 | Fed. Rep. of Germany | 239/600 |

*Primary Examiner*—Andres Kashnikow
*Assistant Examiner*—Kevin P. Weldon
*Attorney, Agent, or Firm*—Hill, Van Santen, Steadman & Simpson

[57] ABSTRACT

A ceramic flat spray tip for a spraying device such as a paint gun provides a flat spray tip composed of ceramic material secured in a surrounding holder which is itself secured into a nozzle assembly in a rotatable fashion. The ceramic spray tip engages the holder through an opening in the holder in such a fashion as to provide for efficient assembly and precise gluing. Alternate embodiments provide for precise insertion of the flat spray tip into the holder and properly aligning the spraying orifice with the holder.

20 Claims, 4 Drawing Sheets

CERAMIC FLAT SPRAY TIP

This is a continuation-in-part of application Ser. No. 418,588, filed 10/10/89 and now abandoned.

BACKGROUND OF THE INVENTION

The present invention relates to spraying tips used with a spraying device, for spraying a material, such as paint. In particular, the invention relates to a ceramic flat spray tip which produces a spray pattern of a generally oblong or flat shape, as opposed to a circular shape.

Flat tip nozzles have been used in connection with airless paint spraying equipment as evidenced by U.S. Pat. No. 4,025,045 assigned to the assignee of the present application. As disclosed in that patent, a discharge end of the spray pistol includes a tip nut which is threadingly received on the gun and which engages over a flange of a guard member which in turn has means for engaging a flange of the nozzle tip, thus, the nozzle tip which includes a noncircular orifice can be firmly held on the front of the spray gun to direct a relatively flat spray. The ledge on the outer diameter of the tip nut is generated as a circle which allows complete rotation of the guard member with respect to the tip nut. However, the inner diameter of the guard member which abuts the outer diameter of the nozzle tip has diametrically opposed flats thereon which mate with flats on the nozzle tip. In this manner, the nozzle tip is not rotatable independently of the guard member.

A flat spray tip producing a flat spray pattern, mounted to a spraying device such as a spray gun, is known to the art. A spray tip which produces a flat pattern must be held securely in the holder to prevent undesired axial rotation of the tip, which would change the orientation of an elongated axis of the flat spray pattern.

Ceramic material, providing excellent wear resistance to the erosive property of paint when sprayed, is an ideal material for use in a flat spray tip. A ceramic spray tip which produces a circular spray pattern is known to the art. However, tips which produce circular spray patterns need not be fixed against axial rotation and thus can be guided or closely captured rather than fixed. Securely holding flat spray tips composed of a non-brittle material such as carbide is known to the art. However, securely holding a brittle material such as a ceramic material is not known to the art and therefore the subject of the present invention.

It is therefore new to the art to provide a ceramic flat spray tip for a spraying device, such as a spray gun, which is securely held into a spray nozzle secured to the spray gun.

SUMMARY OF THE INVENTION

It is an object of the present invention to provide a flat spray tip for a spraying device such as a paint gun which exhibits excellent wear resisting properties; is held securely into a spray tip holder, preventing axial rotation during spraying; can be quickly and easily installed into the holder during manufacture; makes assembly relatively foolproof; and comprises a minimum of parts.

The object is accomplished in that a ceramic spray tip is utilized providing excellent wear resistance to spraying induced erosion; the ceramic spray tip can be glued into the holder and either the holder or the ceramic spray tip is provided with means to prevent glue from penetrating outward of the holder during installation, and possibly fouling a discharge orifice of the spray tip; the ceramic spray tip can be secured into the holder by providing the holder or the spray tip with integral ribs tightly engaged against the ceramic spray tip when inserted; the ceramic spray tip is fashioned of a shape which permits insertion into the holder from a rearward side only; a ledge is provided on either the ceramic spray tip or the holder which prevents the ceramic spray tip from being excessively inserted into the holder and thus protruding outward of the holder excessively; the ceramic spray tip can be provided with means to positively insure correct orientation of the ceramic spray tip with the holder, such as tabs; and minimum parts are utilized by securing the ceramic spray tip to the holder by an adhesive, or by ribs tightly engaging the ceramic spray tip.

DETAILED DESCRIPTION OF THE PREFERRED EMBODIMENTS

Figure 1:
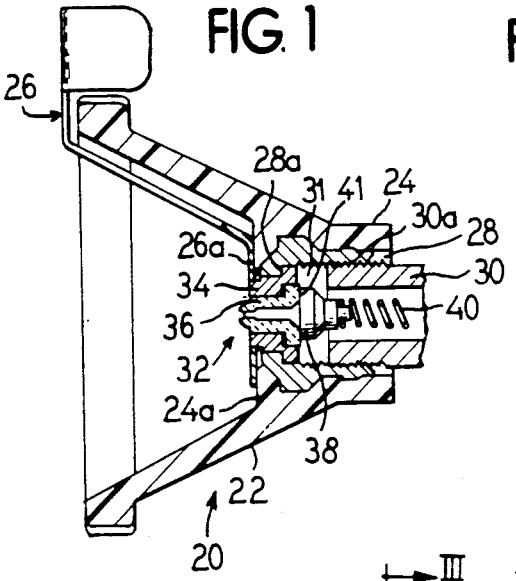
FIG. 1 is a sectional view of a nozzle assembly.

FIG. 1 shows a nozzle assembly generally at 20. The nozzle assembly 20 includes a safety barrier 22, a housing cylinder or retaining nut portion 24 and a rotatably movable actuating lever 26. Preferably, the safety barrier 22 and retaining nut portion 24 comprise an integral molded plastic item. An internally threaded insert 28 is molded inside the retaining nut portion 26. A paint conduit 30, such as a barrel of a paint spray cup gun, opened to an interior 31 of the insert 28, threadingly engages the threaded insert 28 at a threaded end 30*a* of the paint conduit 30 and engages a spray device at a remote end (not shown).

Residing interior of the retaining nut portion 26 is a spray nozzle 32 including a holder 34, and a spray tip 36. A swirl valve 38, and a retention spring 40 also reside therein. The swirl valve 38 abuts an open rear end 41 of spray nozzle 32, and is pressed thereagainst by the retention spring 40. The spray tip 36 resides interior of the holder 34. The spray tip 36 is composed of a ceramic material which provides excellent wear resistance to the erosive property of liquid being sprayed, such as paint. Spray tips 62, 108 described below are also composed of ceramic material. It has been determined that a preferred ceramic material, referred to as GTC-TA, manufactured by the Diamonite Products division of W. R. Grace & Co., being a transformation toughened aluminum oxide material, can be injection molded into the desired configuration described herein without requiring any further machining as required by conventional carbon tungsten spray tips, thus greatly reducing manufacturing costs. However, such material is more brittle, and, thus, has a greater susceptibility to fracture than does carbon tungsten, thereby requiring a unique mounting arrangement not necessary with conventional spray tips.

A spraying fluid such as paint enters the paint conduit 30 from the spraying device (not shown), moves into the swirl valve 38, passes from the swirl valve 38 through the spray tip 36, and thereupon exits the spray tip 36 in a selective spray pattern having an axial centerline generally collinear with an axis of the spray tip 36.

The spray tip 36 is secured to the holder 34, and the actuating lever 26 grips a perimeter of the holder 34 to prevent retraction of the holder 34 out of the retaining nut portion 24 towards the conduit 30 and providing that rotation of the actuating lever 26 about the axis of the spray tip 36, results in rotation of the holder 34 which rotates the spray tip 36. Rotation of the spray tip 36 causes rotation of the axial centerline of the spray pattern discharged from the spray tip 36. Where the spray pattern is unsymmetrical about the axial centerline such as a flat spray pattern, selective rotation causes an elongated axis of the flat spray pattern to rotate to a desired angular orientation.

Figure 2:
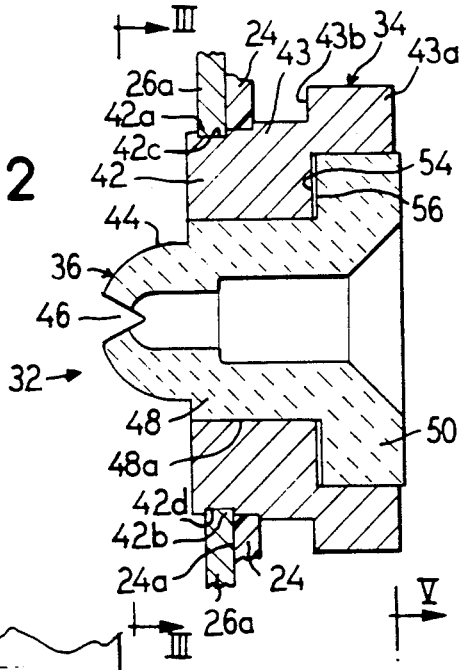
FIG. 2 is an enlarged sectional view of a portion of the nozzle assembly depicted in FIG. 1, in particular a spray nozzle.

FIG. 2 shows in sectional view, the preferred embodiment of the spray nozzle 32 gripped by an annular engagement end 26*a* of the actuating lever 26. The holder 34 comprises: an oblong barrel 42, a cylindrical barrel 43 and an outer ring portion 43*a*. The holder 34 is gripped by the engagement end 26*a* of the actuating lever 26 about the oblong barrel 42. The oblong barrel 42 provides two recesses 42*a*, 42*b* on opposing sides of an end of the oblong barrel 42 forward of a forward surface 24*a* of the retaining nut portion 24, when the holder 34 is in an installed position. The recesses 42*a*, 42*b* provide flat surfaces 42*c*, 42*d*, respectively. The engagement end 26*a* of the actuating lever 26 snaps into the recesses 42*a*, 42*b* and abuts the forward surface of the retaining nut portion 24. A central opening 26*b* of the engagement end 26*a* is sized to stretch over an extreme forward end 34*a* of the holder and spring back into the recesses 42*a*, 42*b*. Thus, the engagement end 26*a* of the actuating lever 26 prevents rearward retraction of the holder 34 toward the conduit 30, acting as lock ring.

The flat surfaces 42*c*, 42*d* provide a keying arrangement whereby the engagement end 26*a* can grip the holder 34 to be rotated by rotation of the actuating lever 26.

A front annular surface 43*b* of the outer ring portion 43*a* abuts a rear surface 28*a* (FIG. 1) of the insert 28, preventing forward removal of the holder 34 from the housing cylinder 24.

The spray tip 36 is engaged interior of the holder 34. The spray tip 36 comprises: a spray ball 44 having a spray orifice 46, a tip sleeve 48, and a collar 50. The tip sleeve 48 is fit tightly inside the oblong barrel 42 and the cylindrical barrel 43 at an interface 48*a*. The collar 50 resides interior of the outer ring portion 43*a* of the holder 34 and abutting a rearward facing step 54 of holder 34. Outer ring 43*a* and the step 54 provide stability to the spray tip 36 during operation, and alignment of the spray tip 36 during installation. The step 54 prevents forward travel of the spray tip 36 once installed. An attachment means such as glue is applied to a forward surface 56 of the collar 50 to secure the spray tip 36 in the holder 34. The interface 48*a* between the tip sleeve 48 and the oblong barrel 42 and the cylindrical barrel 43 provides a close fitting arrangement to prevent glue from forward travel during installation of the spray tip 36 into the holder 34, thus preventing fouling of the spray orifice 46 with glue.

Figure 3:
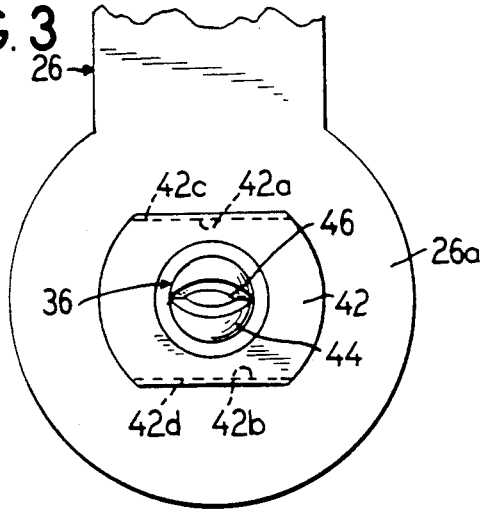
FIG. 3 is an elevational view of the spray nozzle depicted in FIG. 2, generally viewed along line III—III.

FIG. 3 shows the annular engagement end 26*a* which surrounds the oblong barrel 42 in a close fit fashion. The oblong barrel 42 comprising the two flat surfaces 42*c*, 42*d* provide a grip for rotation of the oblong barrel 42 by rotation of actuating lever 26. Spray ball 44 comprises a generally hemispherical shape and has a spray orifice 46 opened to an interior of the spray tip 36. The spray orifice 46 in the preferred embodiment is an oblong opening which provides a flat shaped spray pattern.

Thus, the holder 34 provides an inventive means to secure the spray tip 36 composed of a brittle material, such as a ceramic material, and provides an arrangement to effectively rotate the spray tip 36 by rotating the holder 34. The spray tip 36, providing a flat spray pattern, is secured into the spray nozzle 32 and can be rotated by the actuating lever 26 to orient the elongated axis of the flat spray pattern. Holders 66, 100, described below, provide the same advantages.

Figure 4:
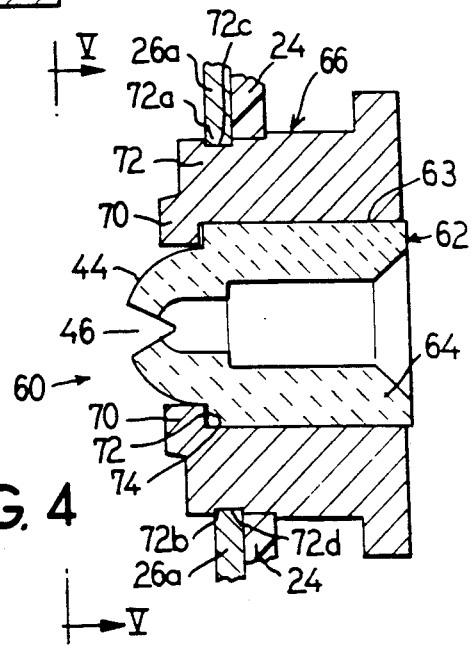
FIG. 4 is a sectional view of an alternate embodiment of the spray nozzle depicted in FIG. 2.

FIG. 4 depicts an alternate embodiment of the present invention wherein a ceramic spray tip 62 comprises a straight cylindrical sleeve 64 without a collar. A holder 66 provides lateral and axial stability along an interface 68 between the holder 66 and the sleeve 64, and a retaining ring portion 70 of the holder 66 opposes forward movement of the spray tip 62 by abutting a rearward surface 72 of the ring portion 70 to a forward surface 74 of the sleeve 64. A means of attachment along the interface 68 can be glue or a frictional fit. The retaining ring portion 70 also acts to prevent glue from traveling forward of the interface 68 which could foul the spray orifice 46. Similar to FIG. 2, the engagement end 26*a* of the actuating lever 26 grips the holder 66 about an oblong barrel portion 72, to prevent retraction of the holder 66 toward the conduit 30 and for rotation of the holder 66. The engagement end 26*a* snaps into recesses 72*a*, 72*b* which function identically to recesses 42*a*, 42*b*, described above.

Figure 5:
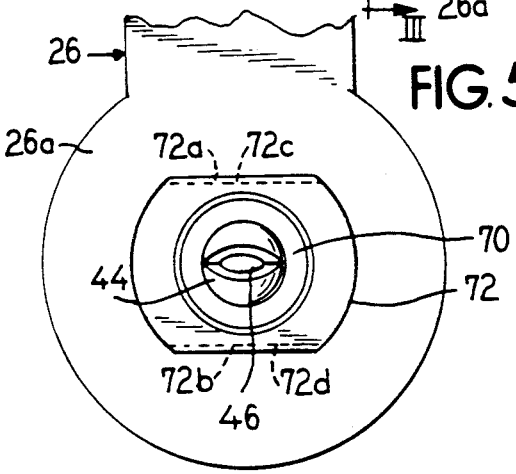
FIG. 5 is an elevational view of the alternate embodiment spray nozzle depicted in FIG. 4, generally viewed along line V—V.

FIG. 5 shows the actuating lever 26 surrounding the oblong barrel portion 72 with the engagement end 26*a* to effectuate rotation and to prevent retraction of the holder 66 toward the conduit 30. The oblong barrel portion 72 comprises two flat surfaces 72*c*, 72*d* interior of recesses 72*a*, 72*b* providing a grip for rotation. The retaining ring portion 70 is shown. The spray ball 44 and the spray orifice 46 are otherwise identical to FIG. 3.

Figure 6:
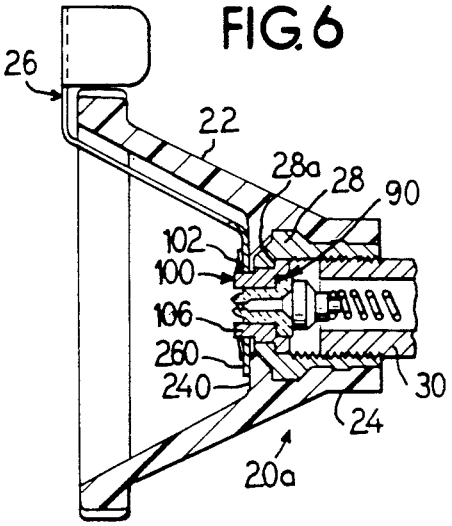
FIG. 6 is a sectional view of an alternate embodiment of the nozzle assembly depicted in FIG. 1.

FIG. 6 shows an alternate embodiment of the nozzle assembly shown in FIG. 1. In this embodiment a longer holder 100 is utilized in conjunction with a separate lock ring 102 which prevents retractive movement of the holder 100 in a rearward direction towards the paint conduit 30. The holder 100 protrudes through the engagement end 26*a* of the actuating lever 26 to be gripped by the lock ring 102. The lock ring 102 can be a known lock ring, such as a Tinnerman lock ring.

Figure 7:
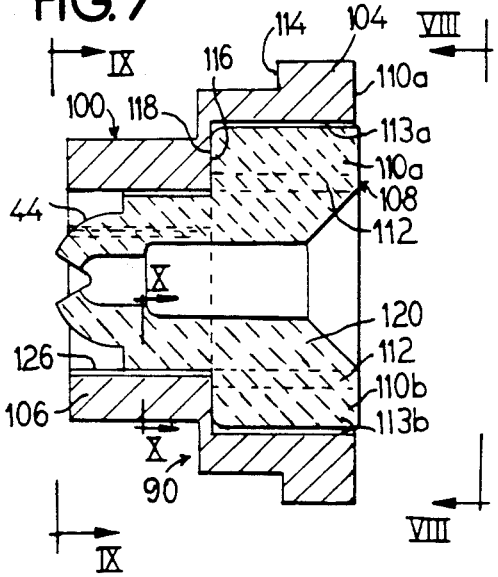
FIG. 7 is an enlarged sectional view of a portion of the nozzle assembly depicted in FIG. 6, in particular a spray nozzle.

FIG. 7 shows the longer holder 100 to be comprised of a formed barrel portion 104 and an extended casing portion 106. The formed barrel portion 104 surrounds a rearward portion of a ceramic spray tip 108 which comprises tabs 110*a*, 110*b* and a rear cylinder portion 112. The tabs 110*a*, 110*b* reside interior of recesses 113*a*, 113*b* of the formed sleeve 104. The recesses 113*a*, 113*b* serve to guide the spray tip 108 into position during installation, and also to prevent rotation of the ceramic spray tip 108 about its axis during operation. A front surface 116 of the tabs 110*a*, 110*b* and the cylinder portion 112 abuts a rear surface 118 of the formed barrel portion 104 thus preventing excessive forward movement of the spray tip 108. FIG. 6 shows extended casing portion 106 of the holder 100 extends forwardly from the formed barrel portion 104 to a position forward of the engagement end 26*a* of the actuating lever 26. In such a position the extended casing portion 106 can be gripped by the lock ring 102 to prevent retraction of the holder 100 toward the paint conduit 30. A forward annular surface 114 of the holder 100 abuts the rear surface 28*a* (FIG. 6) of the insert 28 preventing forward removal of the holder 100 from the housing cylinder 24.

FIG. 7 shows a longitudinal sleeve 120 of the spray tip 108. The extended casing portion 106 of the holder 100 provides on an interior circumference three longitudinal ribs 126 at approximately 120° spacing. When the ceramic spray tip 108 is inserted into the holder 100 from a rearward opening, the tabs 110*a*, 110*b* align with the recesses 113*a*, 113*b* which guide and retain the ceramic spray tip 108 in a proper orientation to the holder 100. Proper projection of the ceramic spray tip 108 into the holder 100 tightly engages the ribs 126 against the sleeve 120 along a length of the ribs 126. The ribs 126, thus tightly compressed against the sleeve 120, provide a secure means of preventing retraction of the ceramic spray tip 108 toward the paint conduit 30, and provide a secure means of preventing axial rotation of the spray tip 108 with respect to the holder 100.

Figure 8:
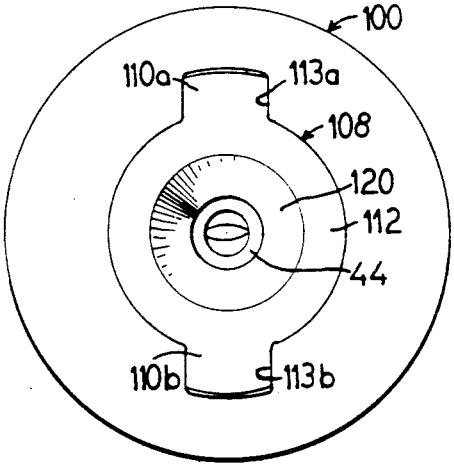
FIG. 8 is an elevational view of the spray nozzle depicted in FIG. 7, generally viewed along line VIII—VIII.

FIG. 8 shows the formed barrel portion 104 and particularly the recesses 113*a*, 113*b* wherein reside the tabs 110*a*, 110*b*. The cylinder portion 112 is also shown.

Figure 9:
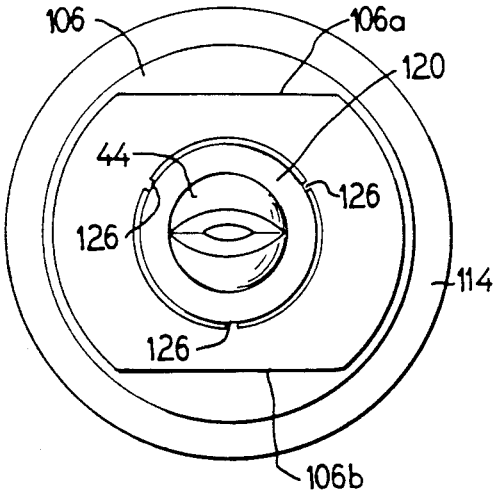
FIG. 9 is an elevational view of the spray nozzle depicted in FIG. 7, generally viewed along line IX—IX.

FIG. 9 shows the three ribs 126 compressed against the sleeve 120 at approximately 120° spacing around the circumference of the sleeve 120. The extended casing portion 106 comprises at a forward end two flat surfaces 106*a*, 106*b* to facilitate gripping by the engagement end 26*a* of the actuating lever 26.

Figure 10:
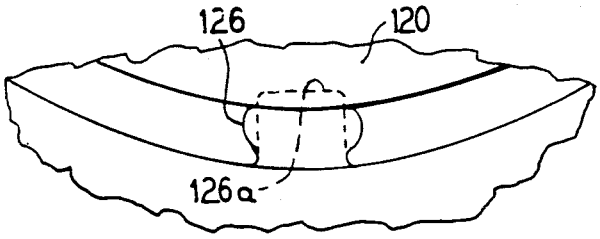
FIG. 10 is an enlarged sectional view of a portion of spray nozzle depicted in FIG. 7, generally along line X—X.

FIG. 10 shows an enlarged view of one of the ribs 126 compressed and deformed against the slots 124 of the longitudinal sleeve 120. The dashed FIG. 126*a* denotes the uncompressed configuration of the rib. The holder and ribs 126 can be made of a material suitable for compression of the ribs such as die-cast zinc.

Figure 11:
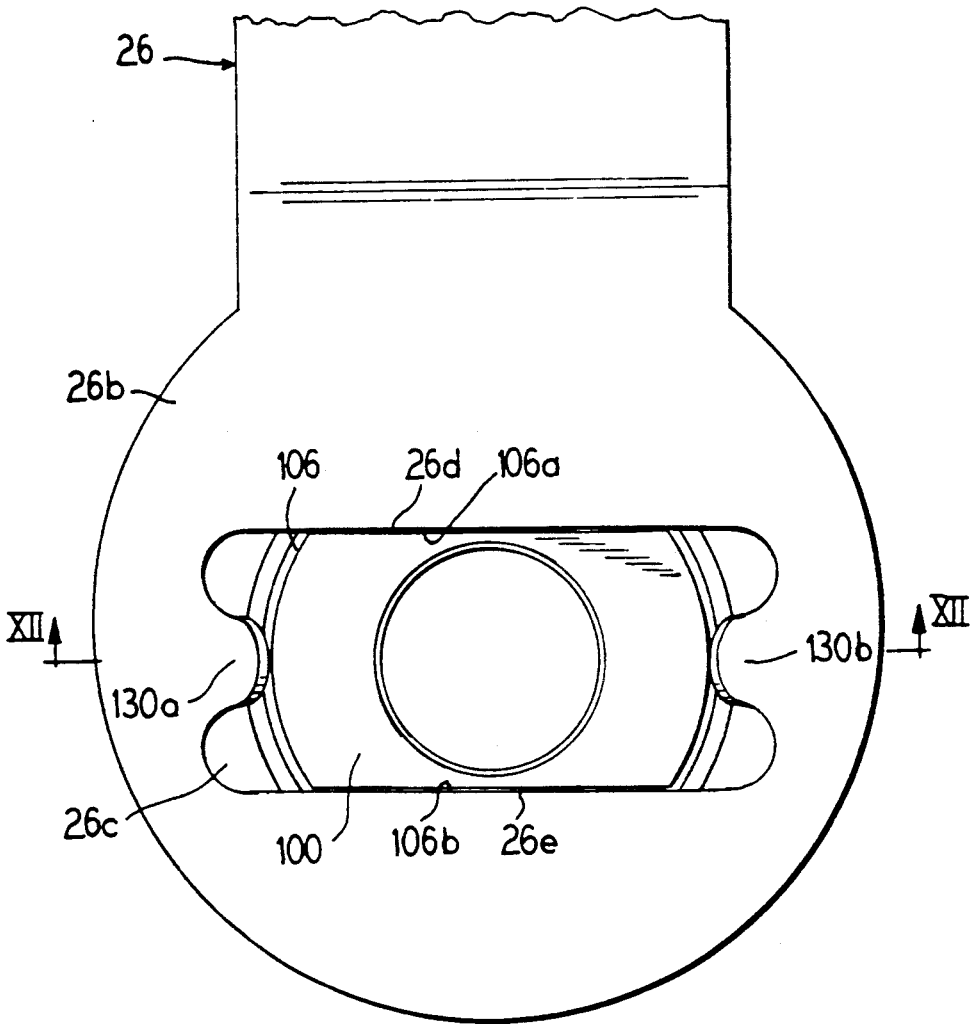
FIG. 11 is an elevational view of an alternate annular engagement end of the actuating lever.

FIG. 11 shows an alternate embodiment of the engagement end of the actuating lever 26: a gripper 26*b*. In this embodiment, a holder, such as holder 100 as shown in FIG. 7, is gripped interior of the gripper 26*b*. The gripper 26*b* provides a central opening 26*c* for receiving the holder 100. The casing portion 106 is gripped by fingers 130*a*, 130*b* along rounded sides 106*c*, 106*d* of the casing portion 106. Similar to the engagement end 26*a*, the gripper 26*b* provides flats 26*d*, 26*e*, which abut flat surfaces 106*a*, 106*b* to fix for rotation the casing portion 106 with the gripper 26*b*.

Figure 12:
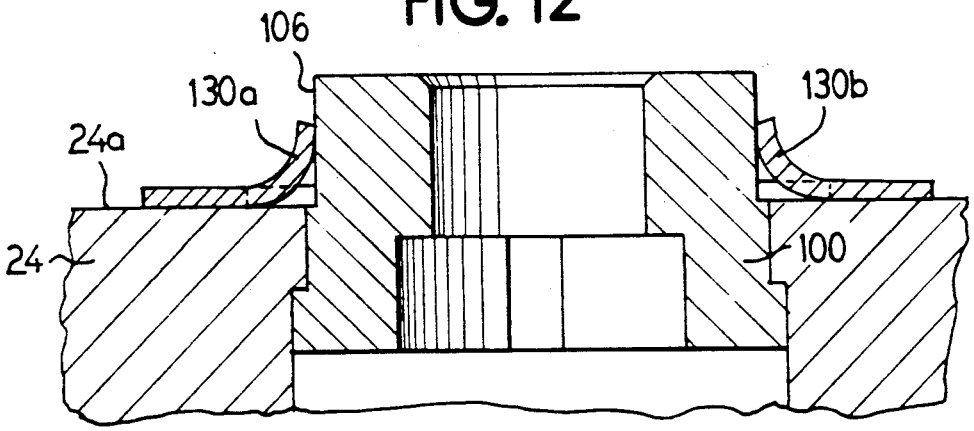
FIG. 12 is a sectional view generally along line XII—XII of FIG. 11.

FIG. 12 shows that when the casing portion 106 is inserted into the housing cylinder 24, the gripper 26*b* is pushed onto the casing portion forward of forward surface 24*a* of the housing cylinder 24.

The fingers 130*a*, 130*b* extend inward of the central opening 26*c* a distance great enough to interfere with the casing portion 106. Thus, the fingers 130*a*, 130*b* bend forwardly as the casing portion 106 is being inserted, while still gripping the casing portion 106. A springing force from the fingers 130*a*, 130*b* caused a tight grip upon the casing portion, preventing rearward retraction of the holder 100 from the forward surface 24*a*.

Figure 13:
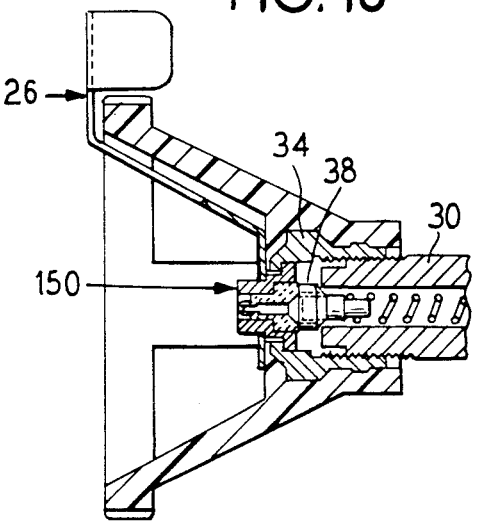
FIG. 13 is a second alternate embodiment of the nozzle assembly of FIG. 1.

FIG. 13 shows a second alternate embodiment of the nozzle assembly of FIG. 1. The assembly of FIG. 13 is similar to the assembly shown in FIG. 6. However, in this assembly of FIG. 13 the paint conduit 30 abuts the swirl valve 38 in sealing fashion. The swirl valve 38 sealingly abuts a fan spray tip 160 in sealing fashion such that paint passes from the paint conduit 30 through the swirl valve 38 and into the fan spray tip 160. The fan spray tip 160 is grippingly held in an alternate holder 150.

Figure 14:
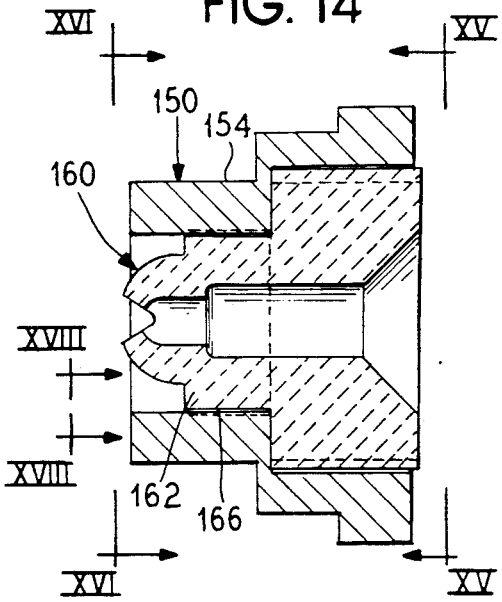
FIG. 14 is an enlarged sectional view of a nozzle holder and a spray tip shown in FIG. 13.
Figure 15:
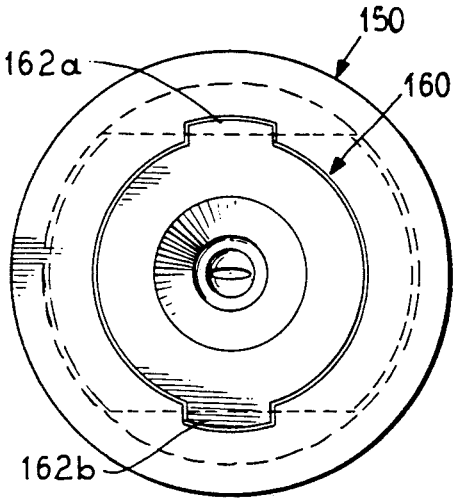
FIG. 15 is an elevational view generally along line XV—XV of FIG. 14.

FIG. 14 shows the alternate holder 150 surrounding the fan spray tip 160. The arrangement of FIG. 14 is nearly identical to the arrangement of FIG. 7. The only substantial difference between FIG. 14 and FIG. 7 is the use of four engaging ribs 166 formed with the spray tip 160 and the elimination from the holder of the longitudinal ribs 126. Rather than forming the ribs 126 on the holder of FIG. 7, as shown in FIG. 14 the engaging ribs 166 are formed on the fan spray tip. FIG. 15 shows the rear view of the holder 150 and the spray tip 160 as being identical to the arrangement of FIG. 8. The fan spray tip 160 has formed thereon alignment tabs 126*a*, 162*b*, identical in function to the tabs 110*a*, 110*b* of FIG. 8, to align assembly of the spray tip 160 in a proper orientation to the holder 150.

Figure 16:
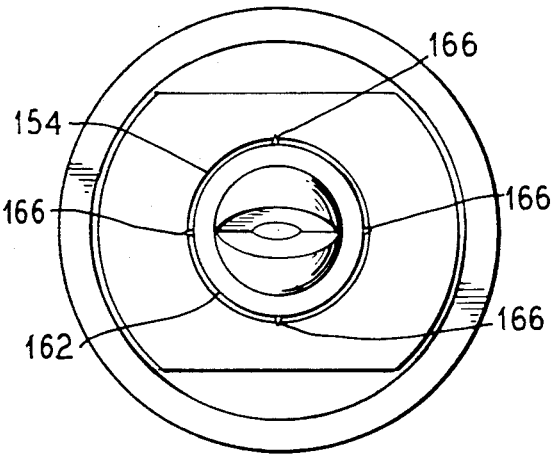
FIG. 16 is an elevational view generally along line XVI—XVI of FIG. 14.

FIG. 16 shows four engagement ribs 166 spaced apart at quarter points around the circumference of a sleeve portion 162 of the spray tip 160. The sleeve portion 162 inserts into a barrel portion 154 of the alternate holder 150.

Figure 17:
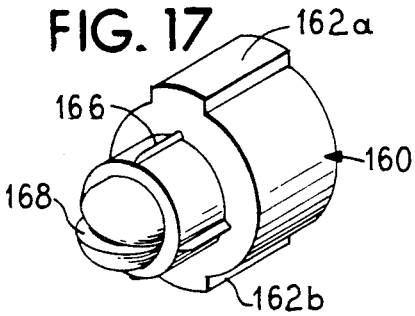
FIG. 17 is a perspective view of the spray tip of FIG. 13 and FIG. 14.

FIG. 17 shows the spray tip separate form the holder. This elongated aperture 168 of the spray tip 160 for a flat spray pattern, as well as the engagement ribs 166 and the alignment tabs 162*a*, 162*b*.

Figure 18:
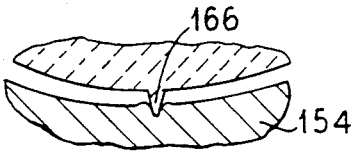
FIG. 18 is an enlarged sectional view generally along line XVIII—XVIII of FIG. 14.

FIG. 18 shows an enlarged sectional view of one engagement rib 166 gripping into or deforming the surface of the barrel portion 154 of the holder 150. The holder 150 is, in the preferred embodiment, formed of a relatively soft metal, such as zinc, which will slightly deform during gripping insertion of the ceramic spray tip 160, more particularly under pressure of the engaging ribs 166.

Thus a plurality of engaging ribs 166 spaced around a circumference of the spray tip engage the holder to prevent axial and rotational movement of the spray tip 160 with respect to the holder 150.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

We claim as our invention:

1. A nozzle assembly for communicating with a spraying device comprising:

a one piece, unitary flat spray tip composed of ceramic material having an axial through cavity therein for transporting material to be sprayed and the cavity terminating at a forward end of said flat spray tip in a flat spray orifice configuration; and a holder means composed of a metallic material softer than said ceramic material mounted with said flat spray tip, preventing translation and rotation of said flat tip with respect to said holder means, said spray tip and holder means having complementary shaped, non-circular engaging peripheral surfaces to prevent rotation of said flat spray tip relative to said holder means;

at least one of said spray tip and said holder means having axially oriented ribs engageable with a surface area on the other of said spray tip and holder means such that the relatively hard ceramic material of said spray tip causes a deformation 84 said relatively soft metal of said holder means at the engagement area of said ribs.

2. A nozzle assembly as claimed in claim 1 wherein said nozzle assembly further comprises a housing cylinder, said housing cylinder surrounding said holder means and said flat spray tip, said housing cylinder having an opening at a forward end for protrusion of a forward end of said holder means and said flat spray tip, and for passing material to be sprayed forwardly, said housing cylinder for mounting said holder means to said spraying device.

3. A nozzle assembly as claimed in claim 2 wherein said nozzle assembly further comprises a lock ring, said lock ring engaged around a periphery of the forward end of said holder means, preventing rearward retraction of said holder means with respect to said housing cylinder.

4. A nozzle assembly as claimed in claim 3, wherein said lock ring engages into recesses formed in the forward end of said holder means.

5. A nozzle assembly as claimed in claim 1 wherein said flat spray tip comprises a sleeve portion, and at least one tab mounted outwardly of said sleeve portion; and said holder means comprises a barrel portion having an opening for receiving said flat spray tip in a tightly fitting fashion around a perimeter of said sleeve portion and said holder means provides a recess for receiving said tab, said tab engaging said recess when said sleeve portion is installed interior of said barrel portion, said tab aligning axial rotational position of said spray tip with said holder means.

6. A nozzle assembly as claimed in claim 5 wherein said flat spray tip comprises two tabs; and said holder means provides two recesses for receiving said tabs.

7. A nozzle assembly as claimed in claim 1 wherein said ribs are formed on said holder means and are deformed by said engaging surface area on said spray tip.

8. A nozzle as claimed in claim 7 wherein said holder means comprises three ribs for compression against said sleeve portion.

9. A nozzle assembly as claimed in claim 6 wherein said nozzle assembly further comprises an actuating lever connected to said holder means, said holder means axially rotatable with respect to said spraying device, said holder means having an axis of rotation generally collinear with an axial centerline of a spray pattern from said flat spray tip, rotation of said actuating lever causing axial rotation of said holder means causing rotation of the axial centerline of the spray pattern from said flat spray tip.

10. A nozzle assembly as claimed in claim 9 wherein said holder means comprises a generally cylindrical shape receiving said flat spray tip interior of said holder means, said flat spray tip communicating forwardly of said holder means through an opening provided at a forward end of said holder means, said holder means comprising at the forward end at least one flat surface on a perimeter of the cylindrical shape; and said actuating lever comprises an engagement end portion which engages said flat surface of said holder means to effectuate axial rotation of said holder means.

11. A nozzle assembly as claimed in claim 10 wherein said nozzle assembly further comprises a housing cylinder, said housing cylinder surrounding said holder means and said flat spray tip, said housing cylinder having an opening at a forward end for protrusion of a forward end of said holder means and said flat spray tip, and for passing material to be sprayed forwardly, said housing cylinder for mounting said holder means to said spraying device; and said engagement end portion comprises two fingers which grip said holder means and prevent rearward retraction of said holder means with respect to said housing cylinder.

12. A nozzle assembly as claimed in claim 1 wherein said ribs are formed on said spray tip and said engaging surface area on said holder means is deformed.

13. A nozzle assembly according to claim 12, wherein said spray tip comprises four ribs aligned at quarter points around a circumference of said spray tip.

14. A nozzle assembly for communicating with a spraying device comprising:

a one piece, unitary spray tip having an elongated orifice which provides a flat spray pattern, said spray tip composed of a ceramic material having a stepped outer diameter;

a holder composed of a metallic material softer than said ceramic material material having a stepped internal passage for receiving said spray tip; and said spray tip and said holder having complementary shaped, non-circular engaging peripheral surfaces to prevent rotation of said flat spray tip relative to said holder;

at least one of said spray tip and said holder having axially oriented ribs engageable with a surface area on the other of said spray tip and holder such that the relatively hard ceramic material of said spray tip causes a deformation of said relatively soft metal of said holder at the engagement area of said ribs.

15. A nozzle assembly as claimed in claim 14, wherein said nozzle assembly further comprises an actuating lever which grips a periphery of said holder and selectively orients the axial rotation of said holder.

16. A nozzle assembly as claimed in claim 15, wherein said nozzle assembly further comprises a housing cylinder with an opening at each axial end and surrounding said holder for connecting said holder to said spraying device, said holder rotatably mounted to said housing cylinder, said actuating lever preventing rearward retraction of said holder with respect to said housing.

17. A nozzle assembly as claimed in claim 16, wherein said holder further comprises a stepped outer diameter which prevents forward removal of the holder from the housing cylinder.

18. A nozzle assembly as claimed in claim 16, wherein said holder provides, at a forward end protruding outward from said housing cylinder, two flat surfaces which are gripped by said actuating lever for rotation.

19. A nozzle assembly as claimed in claim 14 wherein said ribs are formed on said spray tip and said engaging surface area on said holder is deformed.

20. A nozzle assembly as claimed in claim 14 wherein said ribs are formed on said holder and are deformed by said engaging surface area on said spray tip.

* * * * *